US008757686B2

(12) United States Patent
Ishida

(10) Patent No.: US 8,757,686 B2
(45) Date of Patent: Jun. 24, 2014

(54) VEHICLE DOOR HANDLE DEVICE

(75) Inventor: Toshihiko Ishida, Niwa-gun (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 13/820,291

(22) PCT Filed: Jul. 29, 2011

(86) PCT No.: PCT/JP2011/004312

§ 371 (c)(1), (2), (4) Date: Mar. 1, 2013

(87) PCT Pub. No.: WO2012/039089

PCT Pub. Date: Mar. 29, 2012

(65) Prior Publication Data

US 2013/0161964 A1 Jun. 27, 2013

(30) Foreign Application Priority Data

Sep. 22, 2010 (JP) ..... 2010-212498

(51) Int. Cl.
*E05B 3/00* (2006.01)

(52) U.S. Cl.
USPC ..... 292/336.3; 292/357; 292/356; 292/348

(58) Field of Classification Search
USPC ..... 292/336.3, 357, 356, 348, 354
See application file for complete search history.

(56) References Cited

U.S. PATENT DOCUMENTS 3,111,338 A * 11/1963 Kimble ..... 292/111
5,123,687 A * 6/1992 Pfeiffer et al. ..... 292/336.3
6,471,262 B1 * 10/2002 Schwab ..... 292/336.3
7,152,893 B2 * 12/2006 Pudney ..... 292/336.3
7,513,544 B2 * 4/2009 Cummins et al. ..... 292/336.3
7,562,916 B2 * 7/2009 Cummins et al. ..... 292/336.3
7,600,795 B2 * 10/2009 Cummins et al. ..... 292/336.3
2010/0192648 A1 * 8/2010 Stauffer et al. ..... 70/282

FOREIGN PATENT DOCUMENTS

DE 19833168 A1 2/2000
JP 2007-85032 A 4/2007
JP 2009-235849 A 10/2009

OTHER PUBLICATIONS

International Search Report (PCT/ISA/210) issued on Dec. 1, 2011, by the European Patent Office as the International Searching Authority for International Application No. PCT/JP2011/004312.

Written Opinion (PCT/ISA/237) issued on Dec. 1, 2011, by the European Patent Office as the International Searching Authority for International Application No. PCT/JP2011/004312.

* cited by examiner

*Primary Examiner* — Mark Williams
(74) *Attorney, Agent, or Firm* — Buchanan Ingersoll & Rooney PC

(57) ABSTRACT

A hand grip has an arm and a leg. The arm and the leg extend through a door outer panel and are supported by a holder member and a frame member in a freely pivotable manner, respectively. By operating the hand grip in the same direction as when a sliding door is opened, the arm is pivoted relative to the holder member retained at an initial position, so that a full close latch mechanism is unlocked. By operating the hand grip in the same direction as when the sliding door is closed, the leg is pivoted relative to the frame member, while the holder member is pivoted relative to the frame member against urging force of a coil spring, so that a full open latch mechanism is unlocked.

7 Claims, 6 Drawing Sheets

VEHICLE DOOR HANDLE DEVICE

FIELD OF THE INVENTION

The present invention relates to a vehicle door handle device that is operated when opening and closing a vehicle sliding door from outside the vehicle.

BACKGROUND OF THE INVENTION

Japanese Laid-Open Patent Publication No. 2007-85032 discloses a vehicle door handle device that includes a frame member, a hand grip, and a link mechanism. The frame member is fixed to the inner side of a panel member forming a vehicle door. The hand grip is provided on the outer side of the panel member and is engaged with and supported by the frame member. The link mechanism is interposed between the frame member and the hand grip. When opening the fully closed door, the hand grip is pulled in the same direction as a first direction along which the vehicle door is moved. This unlocks a full close lock mechanism. When closing the fully opened vehicle door, the hand grip is operated in a second direction along which the vehicle door is moved, that is, in a direction opposite the first direction. This slides the hand grip via the link mechanism, unlocking a full open lock mechanism. In this manner, by operating the hand grip in the same direction in which the vehicle door is moved, the vehicle door can be smoothly opened or closed through a series of actions.

Japanese Laid-Open Patent Publication No. 2009-235849 discloses a vehicle door handle device that includes a hand grip, a push button switch used for initiating transmission for locking, a capacitance sensor used for initiating transmission for unlocking, and a communications antenna. These switches are used for generating triggers when the vehicle door is opened or closed. When a user carrying a user authentication device such as a portable device approaches the vehicle and operates a switch, the lock mechanism is unlocked after the user matching is confirmed. The vehicle door is then electrically opened or closed.

Japanese Laid-Open Patent Publication No. 2007-85032 has no description of a method for assembling the frame member and the hand grip, which are arranged on the inner side and the outer side of the panel member, respectively, via the link mechanism. In reality, it is assumed that a component formed by unitizing the frame member, the hand grip, and the link mechanism is fixed to the panel member. In this case, however, the entire component is virtually exposed to the outside of the vehicle, which lowers the antitheft reliability. Also, sufficient joint strength with the panel member may not be ensured.

According to the vehicle door handle device of Japanese Laid-Open Patent Publication No. 2007-85032, the user needs to operate a switch to a specific position to open or close the vehicle door. Therefore, depending on the position or size of the switch, the usability is lowered. Specifically, the user needs to operate the switch by grasping the hand grip, while fixing an operational fulcrum with a finger on the hand grip. This inevitably degrades the operability.

CITATION LIST

Patent Literature

[PTL 1]
Japanese Laid-Open Patent Publication No. 2007-85032
[PTL 2]
Japanese Laid-Open Patent Publication No. 2009-235849

SUMMARY OF INVENTION

Accordingly, it is an objective of the present invention to provide a vehicle door handle device that is easily assembled and allows a vehicle door to be opened or closed by operating a hand grip in a direction that does not generate unnatural sensation.

To achieve the foregoing objective and in accordance with a first aspect of the present invention, a configuration is provided that includes: a frame member adapted to be fixed to an inner surface of a panel member of a vehicle door that is movable forward or rearward of the vehicle; a holder member pivotably coupled to a front end or a rear end of the frame member; an urging member for urging the holder member so as to retain the relative position of the holder member with respect to the frame member at an initial position; a hand grip adapted to be arranged outside of the panel member; a pair of first and second coupling portions that are provided at the front end and the rear end of the hand grip, the coupling portions being pivotably supported by the holder member and the frame member while extending through the panel member; a full close latch mechanism for holding the vehicle door at a fully closed state; and a full open latch mechanism for holding the vehicle door at a fully open state. By operating the hand grip in either one of the direction in which the vehicle door in the fully closed state is opened and the direction in which the vehicle door in the fully open state is closed, the second coupling portion of the hand grip is pivoted about the first coupling portion relative to the holder member that is retained at the initial position by the urging member, so that the vehicle door is released either from the fully closed state or the fully open state. By operating the hand grip in the other one of the direction in which the vehicle door in the fully closed state is opened and the direction in which the vehicle door in the fully open state is closed, the first coupling portion of the hand grip is pivoted about the second coupling portion relative to the frame member while the holder member is pivoted relative to the frame member against urging force of the urging member, so that the vehicle door is released from the other one of the fully closed state and the fully open state.

Either in an opening operation or closing operation of the vehicle door, the vehicle door is opened or closed by operating the hand grip in the same direction in which the vehicle door moves, so that the full close latch mechanism or full open latch mechanism is unlocked. Therefore, the opening or closing operation of the vehicle door does not generate unnatural sensation. Particularly, the first coupling portion and the second coupling portion of the hand grip are supported in a freely pivotable manner by the holder member and the frame member, respectively. Thus, the hand grip can be easily assembled with the panel member by causing the first coupling portion and the second coupling portion to penetrate the panel member from outside so that the first and second coupling portions are fitted to the holder member and the frame member, respectively.

The "operational force for unlocking" refers to a force for ultimately unlocking the full close latch mechanism or the full open latch mechanism. Specifically, the operational force for unlocking may be an "operational force of hand grip that is transmitted via a mechanical coupling" or an "electrical unlocking force that is triggered by operational force of the hand grip".

In the above vehicle door handle device, it is preferable that the panel member have a through hole through which the second coupling portion extends and a cap member adapted for closing a gap extending forward from the through hole, a set of a recess and projection be provided between the hand grip and the cap member. It is also preferable that, when the hand grip is operated in the same direction as when the vehicle door is closed so as to pivot the holder member relative to the frame member, the set of a recess and projection inhibit the second coupling portion from pivoting relative to the holder member.

This configuration allows the holder member to pivot relative to the frame member, so that the full open latch mechanism will be unlock. At this time, the set of a recess and projection prevents operational force that unlocks the full close latch mechanism from being generated. Therefore, the operational reliability of the device is increased.

In the above vehicle door handle device, it is preferable that the holder member be secured to the frame member to be freely pivotable, and that, when the hand grip is operated in the same direction as when the vehicle door is closed so as to pivot the holder member relative to the frame member, the first coupling portion slide on the holder member.

According to this configuration, when the holder member pivots relative to the frame member, the displacement of the first coupling portion due to the pivoting of the holder member is accommodated by sliding of the holder member. In contrast, the holder member is secured to the frame member to be freely pivotable. This allows the holder member to be stably pivoted.

The above vehicle door handle device preferably has a guide projection provided in the frame member which the guide projection guides pivoting of the second coupling portion relative to the holder member. It is preferable that a guide groove for receiving the guide projection be formed in the second coupling portion, and that the first coupling portion pivot about the guide projection and relative to the frame member.

According to this configuration, the guide projection fitted in the guide groove guides pivoting motion of the second coupling portion relative to the holder member. This allows the hand grip to be more stably moved. Also, the guide projection may be used as an axis about which the first coupling portion pivots relative to the frame member.

In the above vehicle door handle device, it is preferable that the second coupling portion have an operational portion, and that when the hand grip is operated in the same direction as when the vehicle door is opened so as to pivot the second coupling member relative to the holder member, the operational portion transmit releasing operational force to a transmitting member that is mechanically coupled to the fully close latch mechanism. It is also preferable that the operational portion have an arcuate surface the center of curvature of which coincides with the pivot center of the first coupling portion, and that when the hand grip is operated in the same direction as when the vehicle door is closed so as to pivot the first coupling portion relative to the frame member, the arcuate surface slide on the transmitting member.

According to this configuration, the first coupling portion is pivoted relative to the frame member as the hand grip is operated in the same direction as when closing the vehicle door. At this time, the arcuate surface of the operational portion slides on the transmitting member. Therefore, even if the second coupling portion is slightly pivoted relative to the frame member as the first coupling portion is rotated relative to the frame member, the unlocking operational force is not transmitted to the transmitting member (the full close latch mechanism). The force required for operating the hand grip is thus reduced.

In the above vehicle door handle device, the amount of operation of the hand grip when it is operated to open the vehicle door in the fully closed state is preferably set to be greater than the amount of operation of the hand grip when it is operated to close the vehicle door in the fully open state.

The above vehicle door handle device preferably includes an actuator, a closing operation switch, and a control circuit. The actuator is driven to unlock the full open latch mechanism. The closing operation switch is switched to a conductive state or a non-conductive state by operating the hand grip in the direction in which the vehicle door in the fully open state is closed. The control circuit detects that the closing operation switch has been switched to the conductive state or the non-conductive state, and drives the actuator.

To achieve the foregoing object and in accordance with a second aspect of the present invention, a vehicle door handle device is provided. The vehicle door handle device includes a frame member, a link member, an urging member, a hand grip, a pair of first and second coupling portions, a full close latch mechanism, and a full open latch mechanism. The frame member is adapted for being fixed to an inner surface of a panel member of a vehicle door that is movable forward or rearward of the vehicle. The link member is pivotably coupled to a front end or a rear end of the frame member. The urging member urges the link member so as to retain the relative position of the link member with respective to the frame member at an initial position. The hand grip is adapted for being arranged outside of the panel member. The first and second coupling portions are provided at the front end and the rear end of the hand grip. The coupling portions are pivotably supported by the frame member via the link member while extending through the panel member. The full close latch mechanism holds the vehicle door at a fully closed state. The full open latch mechanism holds the vehicle door at a fully open state. By operating the hand grip in either one of the direction in which the vehicle door in the fully closed state is opened and the direction in which the vehicle door in the fully open state is closed, the second coupling portion of the hand grip is moved relative to the link member that is retained at the initial position by the urging member, so that the vehicle door is released either from the fully closed state or the fully open state. By operating the hand grip in the other one of the direction in which the vehicle door in the fully closed state is opened and the direction in which the vehicle door in the fully open state is closed, the first coupling portion of the hand grip is moved relative to the frame member while the link member is pivoted relative to the frame member against urging force of the urging member, so that the vehicle door is released from the other one of the fully closed state and the fully open state. The above vehicle door handle device further includes an actuator, a closing operation switch, and a control circuit. The actuator is driven to unlock the full open latch mechanism. The closing operation switch is switched to a conductive state or a non-conductive state by operating the hand grip in the direction in which the vehicle door in the fully open state is closed. The control circuit detects that the closing operation switch has been switched to the conductive state or the non-conductive state, and drives the actuator.

BRIEF DESCRIPTION OF DRAWINGS

FIG. 1(*b*) is a schematic side view showing the vehicle door handle device, as seen from inside.

FIG. 4(*b*) is an enlarged schematic plan view illustrating the arm as a first coupling portion in FIG. 4(*a*).

FIG. 5(*b*) is an enlarged schematic plan view illustrating the arm as a first coupling portion in FIG. 5(*a*).

FIG. 7(*b*) is an enlarged schematic plan view illustrating an arm as a first coupling portion in FIG. 7(*a*) when the sliding door is opened.

FIG. 7(*c*) is an enlarged schematic plan view illustrating the arm as a first coupling portion in FIG. 7(*a*) when the sliding door is closed.

DETAILED DESCRIPTION OF THE PREFERRED EMBODIMENTS

First Embodiment

A vehicle door handle device according to a first embodiment of the present invention will now be described with reference to FIGS. 1 to 6. When describing the vehicle door handle device of the present invention, a side located closer to the vehicle outside with respect to the widthwise direction of the vehicle is referred to as an outside, and side facing the passenger compartment is referred to as an inside. Also, the advancing direction of the vehicle is referred to as the front.

Figure 6:
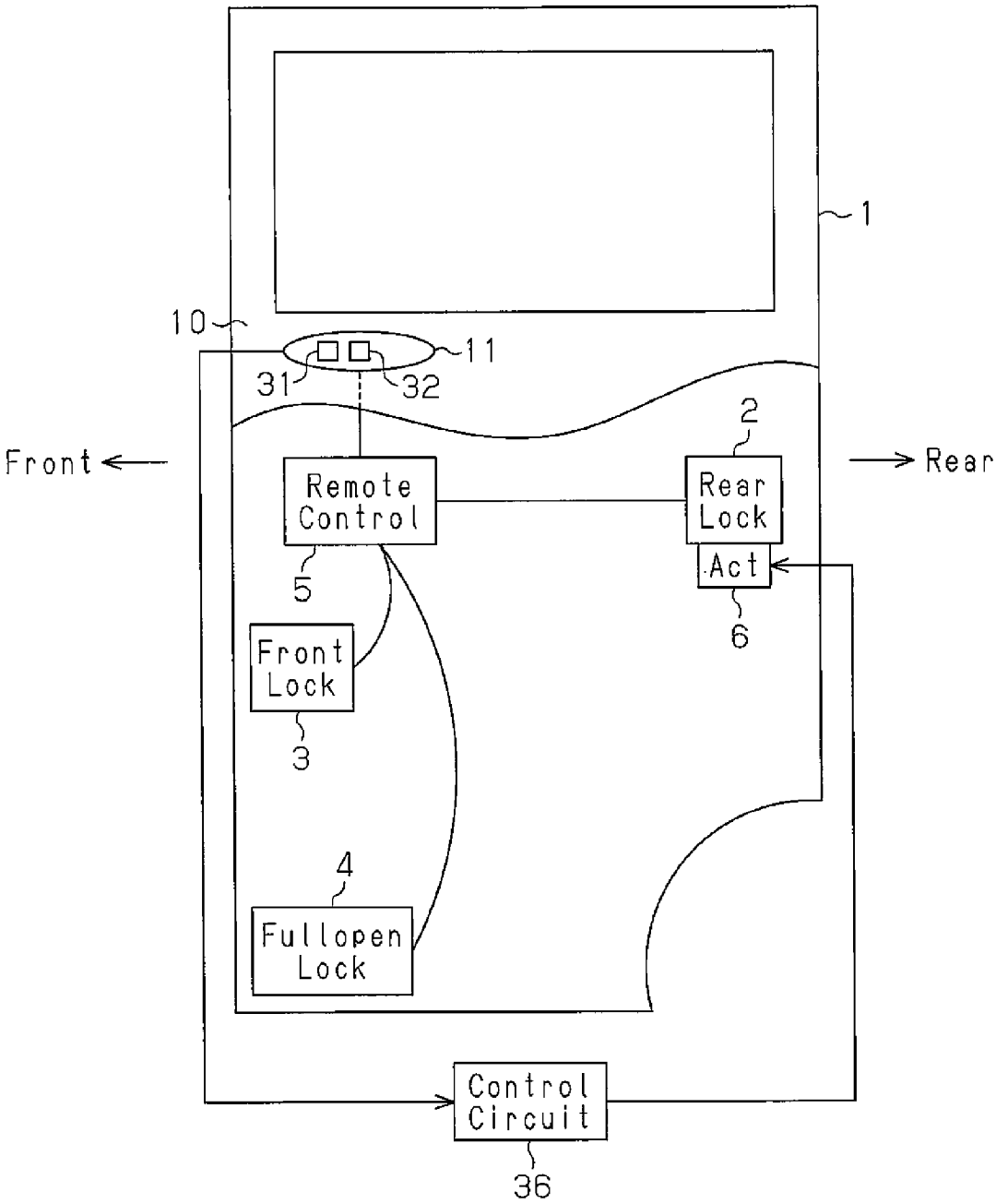
FIG. 6 is a schematic front view showing a sliding door in which the vehicle door handle device of the present invention is used.

As shown in FIG. 6, a sliding door 1 is moved forward or rearward to open or close an opening for allowing entry and exit formed in the vehicle body. A rear lock 2 is provided in a rear portion of the sliding door 1, and a front lock 3 is provided in a front portion of the sliding door 1. The rear lock 2 and the front lock 3 form a full close latch mechanism and hold the sliding door 1 at the fully closed state. A full open lock 4, which serves as a full open latch mechanism, is provided in a front lower portion of the sliding door 1. The full open lock 4 holds the sliding door 1 at the fully open position.

The sliding door 1 has a remote control 5 above the front lock 3. The remote control 5 is mechanically connected to the rear lock 2, the front lock 3, and the full open lock 4. The remote control 5 is also mechanically connected to a hand grip 11 provided on a door outer panel 10. The door outer panel 10 forms a panel member of the sliding door 1. The hand grip 11 is made of resin and extends in front-rear direction. When the hand grip 11 is moved in the direction for opening the sliding door 1, the operational force is transmitted to the rear lock 2, the front lock 3, and the full open lock 4 by the remote control 5. Accordingly, the sliding door 1 is released from a fully closed state or a fully open state.

The sliding door 1 also has an actuator 6 located in the vicinity of the rear lock 2. The actuator 6 is coupled to and drives the rear lock 2, and is mechanically linked to the remote control 5. When the actuator 6 is driven, the drive force is transmitted to the rear lock 2. The drive force is also transmitted to the front lock 3 and the full open lock 4 via the remote control 5. Accordingly, the sliding door 1 is released from a fully closed state or a fully open state.

Figure 1:
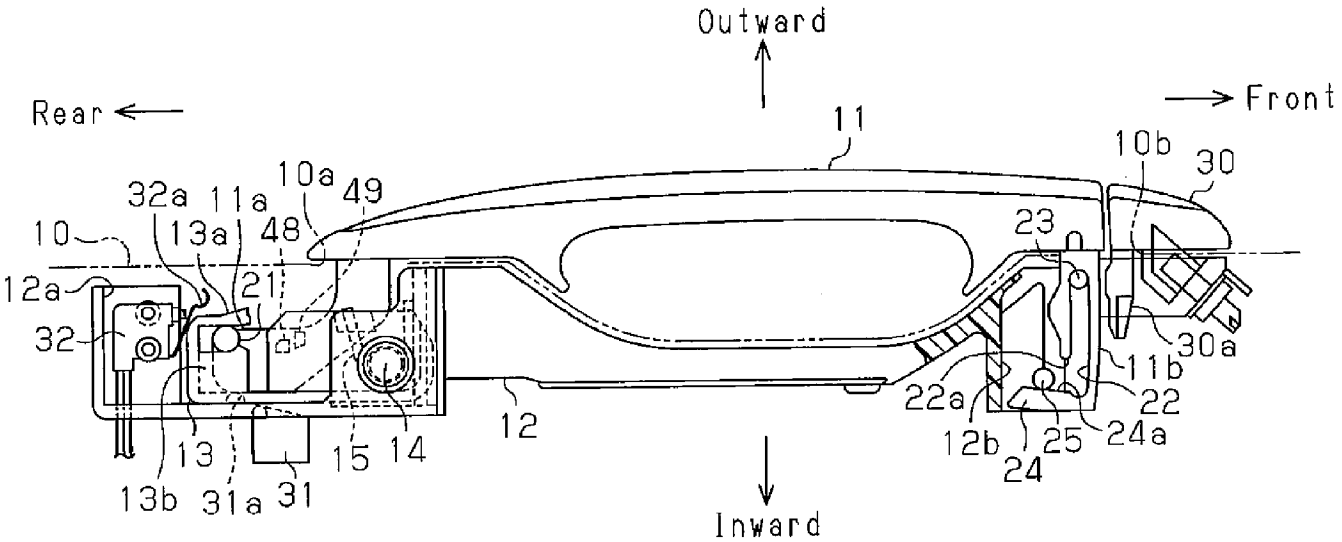
FIG. 1(*a*) is a schematic plan view illustrating a vehicle door handle device according to a first embodiment of the present invention.
Figure 1:
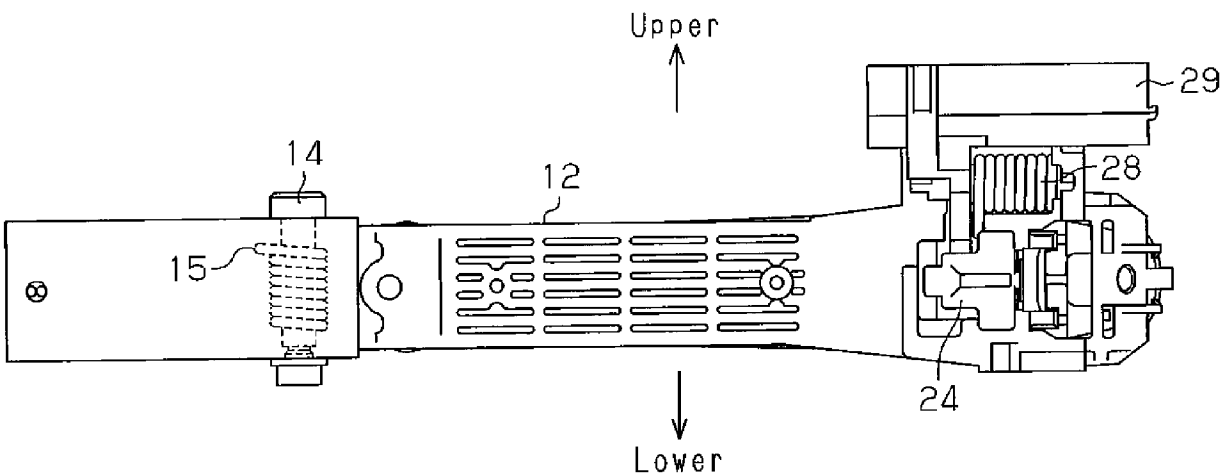

As shown in FIGS. 1(*a*) and 1(*b*), the vehicle door handle device includes a resin frame member 12 fixed to the inner side of the door outer panel 10. The outside surface of the frame member 12 is shaped along the outer shape of the door outer panel 10. An accommodation portion 12*a* is provided at the rear end of the frame member 12, and an opening 12*b* is provided at the front end of the frame member 12. The sliding door 1 is moved rearward to be opened, and moved forward to be closed. The accommodation portion 12*a* is formed into a substantially rectangular box opening outward. The opening 12*b* extends along the vehicle widthwise direction and through the frame member 12. The door outer panel 10 has through holes 10*a*, 10*b* at positions corresponding to the accommodation portion 12*a* and the opening 12*b* of the frame member 12.

The vehicle door handle device includes a resin holder member 13, which is formed into a substantially rectangular box and located in the accommodation portion 12*a*. The front end of the holder member 13 is pivotably coupled and secured to the frame member 12 via a pin 14. The pin 14 extends in the up-down direction of the vehicle. The pin 14 extends through a coil spring 15, which serves as an urging member. The ends of the coil spring 15 are engaged with the frame member 12 and the holder member 13, respectively. The coil spring 15 urges the frame member 12 and the holder member 13 so as to retain the frame member 12 and the holder member 13 at initial relative positions thereof. At the initial positions, the bottom walls of the frame member 12 and the holder member 13 overlap with each other. A forward extending support portion 13*a* is formed at the open end of the holder member 13. A pair of forward extending upper and lower support wall portions 13*b* is formed at the rear wall of the holder member 13.

The hand grip 11 has an arm 11*a* serving as a first coupling portion and a leg 11*b* serving as a second coupling portion. The arm 11*a* extends inward from a rear end of the hand grip 11 that faces the holder member 13. The leg 11*b* extends inward from a front end of the hand grip 11 that faces the opening 12*b* of the frame member 12. The arm 11*a* is inserted into the holder member 13 from outside of the through hole 10*a* of the door outer panel 10, and the leg 11*b* is inserted into the opening 12*b* from outside of the through hole 10*b* of the door outer panel 10. In this manner, the hand grip 11 is coupled to the frame member 12 with the door outer panel 10 located between the hand grip 11 and the frame member 12.

Figure 2:
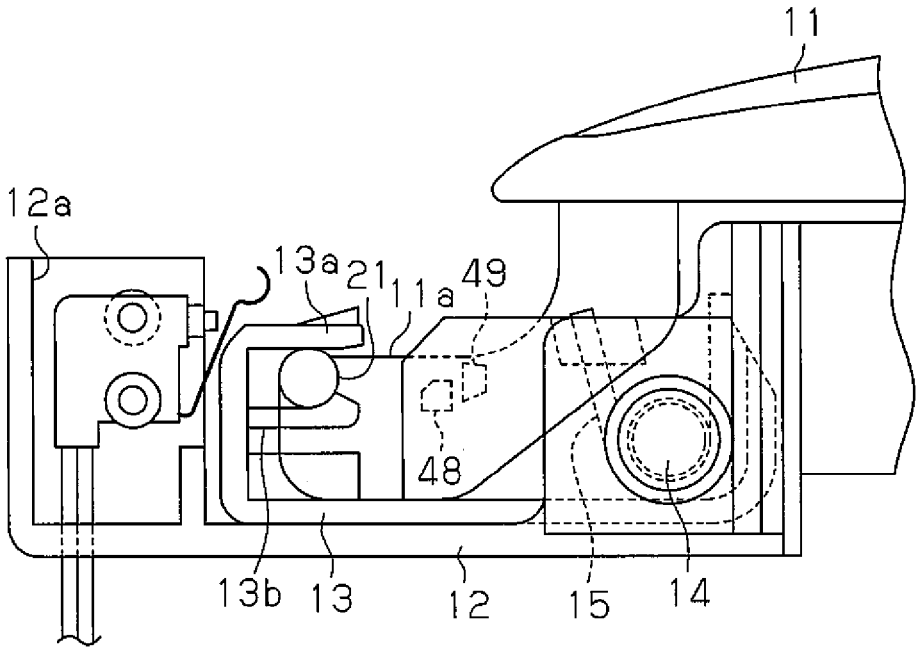
FIG. 2 is an enlarged schematic plan view illustrating an arm as a first coupling portion.

The hand grip 11 is pivotably supported by the holder member 13 via the arm 11*a*. As shown in FIG. 2, a columnar pivot coupling portion 21 is provided at the distal end of the arm 11*a*. The pivot coupling portion 21 extends in the up-down direction. The pivot coupling portion 21 is located in the holder member 13 and held by the support portion 13*a* and the support wall portions 13*b*. The arm 11*a* is supported to be pivotable about the pivot coupling portion 21 in the holder member 13.

The pivot coupling portion 21 is permitted to move slightly rearward between the support portion 13*a* and the support wall portions 13*b*. A handle projection 48 is formed on each of the upper surface and the lower surface of the arm 11*a*. The handle projections 48 are located forward of the pivot coupling portion 21. The handle projections 48 are arranged to contact a part close to the rear side or the rear side of a link projection 49 provided in the holder member 13. When the hand grip 11 is pulled hard, the handle projections 48 and the link projection 49 contact each other. This prevents the hand grip 11 from falling off the holder member 13.

The hand grip 11 is pivotably supported by the frame member 12 via the leg 11*b*. A guide groove 22 is formed on each of the upper surface and the lower surface of the leg 11*b*. The guide grooves 22 extend along an arc the center of curvature of which coincides with the pivot coupling portion 21. A rearward opening 22*a* is provided at the inner end of each guide groove 22. A pair of substantially columnar pins 23 is provided in the opening 12*b* of the frame member 12. The pins 23 are fitted in the guide grooves 22. The leg 11*b* is supported to be pivotable about the pins 23 in the guide grooves 22, while allowing the holder member 13 to pivot about the pin 14 relative to the frame member 12. When the holder member 13 is pivoted about the pin 14 from the initial position relative to the frame member 12, the pivot coupling portion 21 moves rearward between the support portion 13*a* and support wall portions 13*b*.

A rearward extending operational portion 24 is provided at the distal end of the leg 11*b*. The operational portion 24 is engaged with a bell crank 25, which is mechanically connected to the remote control 5. Accordingly, the hand grip 11 is operated rearward, which is the same direction in which the sliding door 1 is opened. Then, a front portion of the hand grip 11 (a portion with the leg 11*b*) is pivoted so as to be opened outward about the pivot coupling portion 21 in the holder member 13 at the initial position. The operational force is transmitted to the bell crank 25 via the operational portion 24. The operational force is transmitted to the rear lock 2, the front lock 3, and the full open lock 4 via the remote control 5. Accordingly, the sliding door 1 is released from a fully closed state or a fully open state.

The hand grip 11 holds a return spring 28 at the front end. The ends of the return spring 28 are engaged with the frame member 12 and the leg 11*b*, respectively. The return spring 28 urges the hand grip 11 so that the hand grip 11 pivots about the pivot coupling portion 21 in the holder member 13 and in a direction to insert the leg 11*b* into the opening 12*b*. Therefore, the coil spring 15 retains the holder member 13 at the initial position, and the return spring 28 holds the leg 11*b* so that the leg 11*b* is inserted in the opening 12*b*. Accordingly, in a normal state, the hand grip 11 is pushed against the door outer panel 10 both at the rear end and the front end. This state of the hand grip 11 will hereafter be referred to as a non-operational state.

A weight 29 for adjusting inertial force in the non-operational state is supported at the front end of the hand grip 11. That is, the urging force of the coil spring 15 is set taking into consideration the balance between the urging force (handle returning force) of the return spring 28 and the inertial force of the weight 29.

A cap member 30 is attached to a part of the door outer panel 10 that is close to the front end of the hand grip 11. An inward extending portion 30*a* is provided on a surface of the cap member 30 that faces the door outer panel 10. The through hole 10*b* extending through the leg 11*b* of the hand grip 11 has a clearance in a front portion. The extending portion 30*a* is inserted in and closes the clearance.

Figure 3:
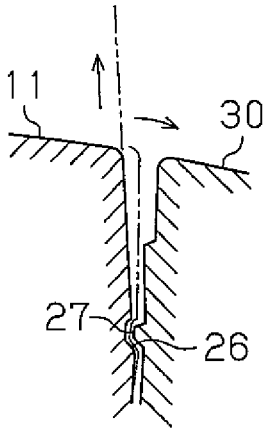
FIG. 3 is a schematic cross-sectional view illustrating a set of a recess and projection provided between the hand grip and the cap member.

A set of a recess and projection is formed between the hand grip 11 and the cap member 30. When the hand grip 11 is operated forward, or in the same direction as when closing the sliding door 1, the holder member 13 is pivoted relative to the frame member 12. At this time, the set of a recess and projection inhibits the arm 11*a* from pivoting relative to the frame member 12. As shown in FIG. 3, an engagement recess 26 is formed in a front face of the hand grip 11 that faces the cap member 30. An engagement projection 27 is formed on a rear face of the cap member 30 that faces the hand grip 11. When the hand grip 11 is pivoted about the pivot coupling portion 21 relative to the holder member 13 at the initial position, the engagement projection 27 does not interfere with the movement path of the engagement recess 26 (the hand grip 11). Therefore, in a normal state, when the hand grip 11 is pivoted about the pivot coupling portion 21, the engagement recess 26 and the engagement projection 27 are not engaged with each other.

In contrast, when the hand grip 11 is operated in the same direction as when closing the sliding door 1, the holder member 13 is pivoted relative to the frame member 12. At this time, when the arm 11*a* is pivoted relative to the frame member 12, the engagement projection 27 is received by the engagement recess 26. Accordingly, the engagement projection 27 contacts the engagement recess 26, so that the engagement recess 26 is pushed back by the engagement projection 27. Accordingly, the arm 11*a* is prevented from being pivoted relative to the holder member 13.

An opening operation switch 31 is attached to the bottom of the accommodation portion 12*a* of the frame member 12. The opening operation switch 31 includes a movable terminal 31*a*. The movable terminal 31*a* extends through the bottom wall of the accommodation portion 12*a* and the bottom wall of the holder member 13, and is pressed against the bottom of the arm 11*a*. In the non-operational state of the hand grip 11, the movable terminal 31*a* of the opening operation switch 31 is in a conduction state. In contrast, when the hand grip 11 pivots about the pivot coupling portion 21, or when the holder member 13 pivots about the pin 14, the movable terminal 31*a* of the opening operation switch 31 follows the movement of the bottom of the arm 11*a*, so as to be in a non-conduction state.

A closing operation switch 32 is attached to the accommodation portion 12*a* of the frame member 12. The closing operation switch 32 is located rearward of the holder member 13. The closing operation switch 32 has a movable terminal 32*a*, which is pressed against the rear side of the holder member 13. When the holder member 13 is at the initial position, the movable terminal 32*a* of the closing operation switch 32 is in a non-conduction state. When the holder member 13 pivots about the pin 14, the movable terminal 32*a* of the closing operation switch 32 is in a conductive state.

As shown in FIG. 6, the opening operation switch 31 and the closing operation switch 32 are electrically connected to the actuator 6 via a control circuit 36. The control circuit 36 controls the actuator 6 in accordance with the state of the opening operation switch 31 and the closing operation switch 32. The control circuit 36 may be located at any part in the sliding door 1 and the vehicle body.

Operation of the vehicle door handle device will now be described with reference to FIGS. 4 and 5.

Suppose that the sliding door 1 is fully closed, and the hand grip 11 is in the non-operational state. A user, who stands next to the sliding door 1, first grips the hand grip 11 and operates the hand grip 11 toward the rearward direction, which is the same direction along which the sliding door 1 is opened. Then, as shown in FIG. 4, the arm 11*a* of the hand grip 11 pivots about the pivot coupling portion 21 relative to the holder member 13, which is retained at the initial position by the coil spring 15. At this time, the movable terminal 32*a* of the closing operation switch 32 is kept in the non-conduction state, and the movable terminal 31*a* of the opening operation switch 31 is switched from the conduction state to the non-conduction state. When the logic of the opening operation switch 31 and the closing operation switch 32 is detected by the control circuit 36, the actuator 6 is activated so that the sliding door 1 is released from the fully closed state. At this time, the operation of the hand grip 11 generates an operational force that switches the logic of the opening operation switch 31. That is, the operation of the hand grip 11 at this stage serves as a trigger for releasing the sliding door 1 from the fully closed state.

Suppose now that the sliding door 1 is fully open, and the hand grip 11 is in the non-operational state. A user, who stands next to the hand grip 11, first grips the hand grip 11 and operates the hand grip 11 forward, which is the same direction along which the sliding door 1 is closed. As shown in FIG. 5, the leg 11*b* of the hand grip 11 pivots about the pin 23 relative to the frame member 12, while pivoting the holder member 13 about the pin 14 relative to the frame member 12 against the urging force of the coil spring 15. At this time, the movable terminal 31*a* of the opening operation switch 31 is switched from the conduction state to the non-conduction state, and the movable terminal 32*a* of the closing operation switch 32 is switched from the non-conductive state to the conductive state. When the logic of the opening operation switch 31 and the closing operation switch 32 is detected by the control circuit 36, the actuator 6 is activated so that the sliding door 1 is released from the fully open state. At this time, the operation of the hand grip 11 generates an operational force that switches the logic of the opening operation switch 31 and the closing operation switch 32. That is, the operation of the hand grip 11 at this stage serves as a trigger for releasing the sliding door 1 from the fully open closed state. A surface of the operational portion 24 that engages with the bell crank 25 is an arcuate surface 24*a*, the center of curvature of which coincides with the pin 23. Therefore, when the leg 11*b* of the hand grip 11 pivots about the pin 23 relative to the frame member 12, the bell crank 25 only slides on the arcuate surface 24*a*, but no operational force (cancelling operational force) by the hand grip 11 is transmitted to the bell crank 25.

Figure 4A:
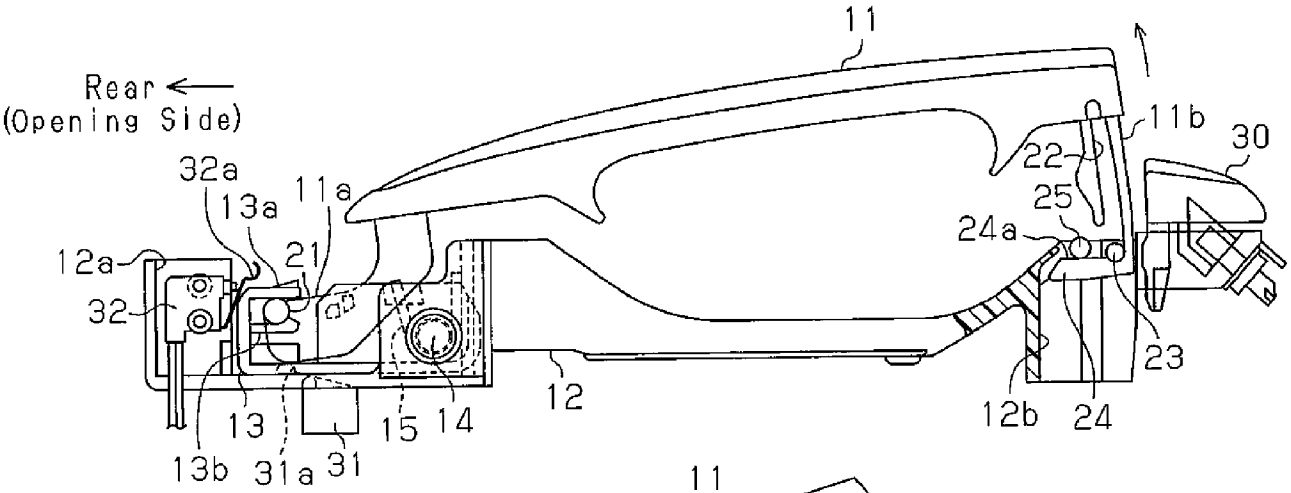
FIG. 4(*a*) is a schematic explanatory plan view showing an action for opening a sliding door.
Figure 4B:
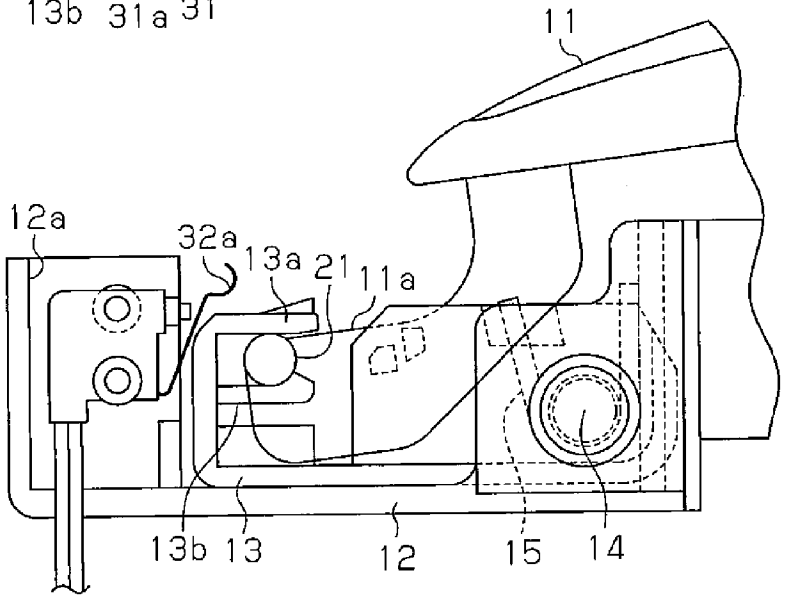
Figure 5A:
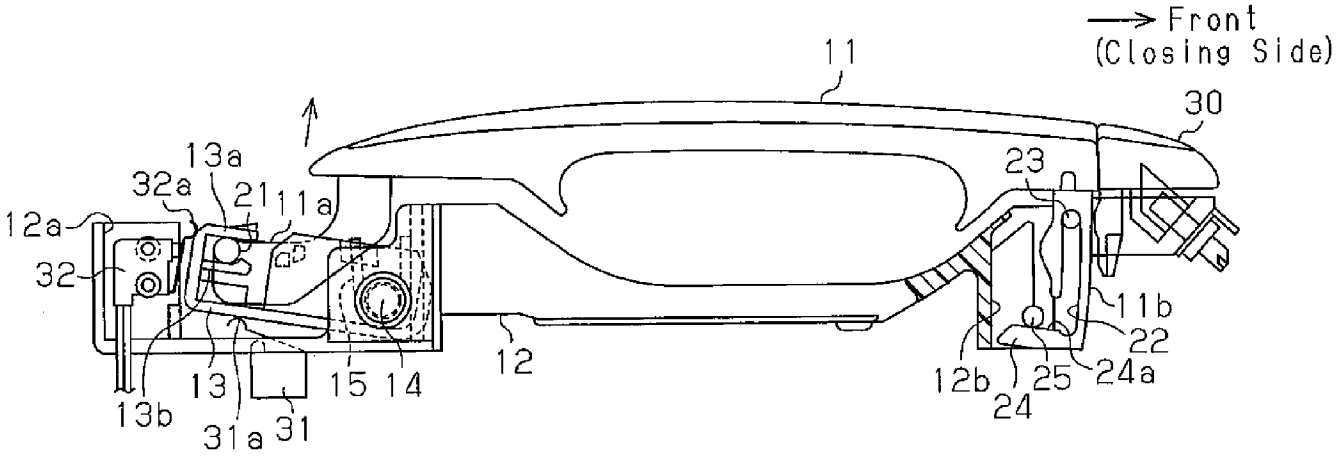
FIG. 5(*a*) is a schematic explanatory plan view showing an action for closing a sliding door.
Figure 5B:
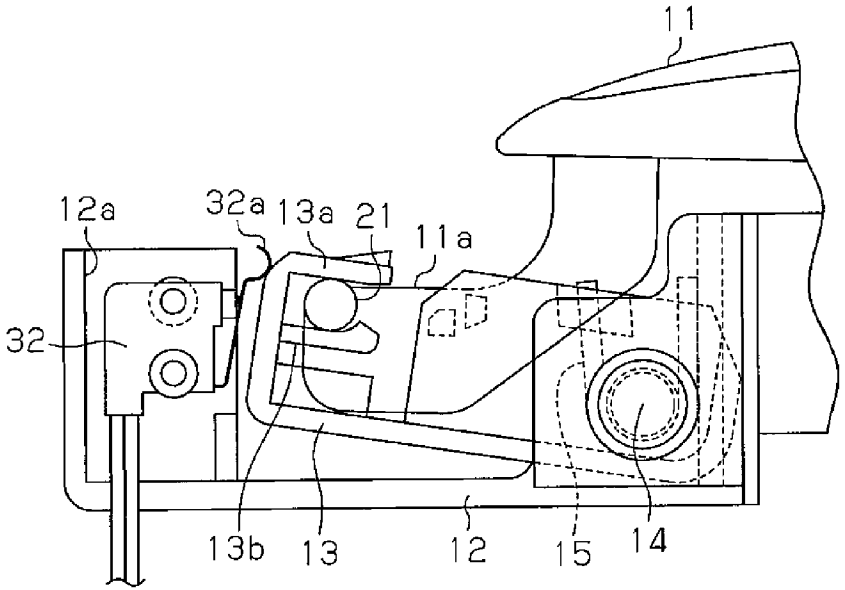

Suppose that the user grips the hand grip 11 and operates the hand grip 11 in the same direction as when opening the sliding door 1, thereby pivoting the hand grip 11 such that the leg 11*b* widely opens outward about the pivot coupling portion 21 serving as a fulcrum as shown in FIG. 4. At this time, operational force is transmitted to the bell crank 25 via the operational portion 24. The operational force is then transmitted to the rear lock 2, the front lock 3, and the full open lock 4 via the remote control 5. In this case, regardless of whether the sliding door 1 is in the fully closed state or the fully open state, the sliding door 1 is released from the fully closed state and the fully open state.

The method for assembly of the present embodiment will now be described.

Prior to the assembly of the hand grip 11, the holder member 13, the opening operation switch 31, and the closing operation switch 32 are assembled with the frame member 12. Next, an assembly body of the frame member 12 is fixed to the inner side of the door outer panel 10. In this state, the arm 11*a* of the hand grip 11 is inserted into the rear through hole 10*a* and the holder member 13. The arm 11*a* of the hand grip 11 is caused to project inward from the door outer panel 10. At this time, the pivot coupling portion 21 of the arm 11*a* has not yet been held between the support portion 13*a* and the support wall portions 13*b* of the holder member 13.

Subsequently, the leg 11*b* of the hand grip 11 is inserted into the front through hole 10*b* and the opening 12*b* of the frame member 12. At this time, the opening 22*a* of the guide grooves 22 is located forward of the pins 23. Then, the hand grip 11 is moved rearward, so that the pivot coupling portion 21 is inserted and held between the support portion 13*a* and the support wall portions 13*b* of the holder member 13. Simultaneously, the pins 23 of the opening 12*b* enter the opening 22*a*, so as to be fitted in the guide grooves 22. This allows the arm 11*a* to be pivotably supported by the holder member 13, and the leg 11*b* is pivotably supported by the frame member 12 via the pins 23. As the hand grip 11 is moved rearward, the bell crank 25 is guided along the operational portion 24 of the leg 11*b*, so that the operational portion 24 is engaged with the bell crank 25. At this time, the clearance formed in front of the through hole 10*b* is closed by the cap member 30.

The above described first embodiment has the following advantages.

(1) By operating the hand grip 11 in the same direction as when opening the sliding door 1, the rear lock 2 and the front lock 3 are unlocked so that the sliding door 1 can be opened. By operating the hand grip 11 in the same direction as when closing the sliding door 1, the full open lock 4 is unlocked so that the sliding door 1 can be closed. Therefore, the opening or closing operation of the sliding door 1 does not generate unnatural sensation. Particularly, the arm 11*a* and the leg 11*b* of the hand grip 11 are supported by the holder member 13 and the frame member 12 in a freely pivotable manner, respectively. Thus, the hand grip 11 can be easily assembled with the door outer panel 10 by causing the arm 11*a* and the leg 11*b* to penetrate the door outer panel 10 from outside so that the arm 11*a* and the leg 11*b* are fitted to the holder member 13 and the frame member 12, respectively.

(2) Operational force of the hand grip 11 pivots the holder member 13 relative to the frame member 12, so that the full open lock 4 is unlocked. At this, the engagement recess 26 of the hand grip 11 and the engagement projection 27 of the cap member 30 prevent generation of operational force that acts to unlock the rear lock 2 and the front lock 3. Therefore, operational reliability of the vehicle door handle device is improved.

(3) When the holder member 13 pivots relative to the frame member 12, the positional displacement of the arm 11*a* due to pivoting of the holder member 13 is accommodated by sliding on the holder member 13. In contrast, the holder member 13 is secured to the frame member 12 to be freely pivotable. This allows the holder member 13 to be stably pivoted.

(4) The pins 23 fitted in the guide grooves 22 guide pivoting of the arm 11*a* relative to the holder member 13. This allows the hand grip 11 to be more stably moved. Also, the pins 23 may be used as an axis about which the leg 11*b* is pivoted relative to the frame member 12.

(5) When the hand grip 11 is operated in the same direction as when closing the sliding door 1, the leg 11*b* is pivoted relative to the frame member 12. At this time, the arcuate surface 24*a* of the operational portion 24 slides on the bell crank 25. In this case, the operational force of the hand grip 11 is not transmitted to the bell crank 25, that is, to the rear lock 2 and the front lock 3. The force required for operating the hand grip 11 is thus reduced.

(6) Compared to the closing operation of the hand grip 11, the amount by which the hand grip 11 needs to be pulled outward to open is set to a greater value. Therefore, even when transmitting operational force to the rear lock 2 via the bell crank 25, the rear lock 2 can be unlocked with a weaker operational force. Particularly, in the fully closed state of the sliding door 1, a great load exists due to reaction force of sealing weatherstrip and resistance in the transmission path to the rear lock 2. In this respect, the present invention allows the rear lock 2 to be unlocked with a weaker operational force.

(7) The opening operation or the closing operation of the hand grip 11 is detected by the opening operation switch 31 and the closing operation switch 32, so that the rear lock 2 can be unlocked. Therefore, a user is allowed to unlock the rear lock 2 without having to be conscious of performing an operation to cancel the open state or the closed state, as in a pushing operation of a button.

(8) The frame member 12 and the hand grip 11 are supported on the inner side and the outer side of the door outer panel 10, respectively. This improves the rigidity and the antitheft reliability of the vehicle door handle device.

Second Embodiment

A vehicle door handle device according to a second embodiment of the present invention will now be described with reference to FIGS. 7(*a*) to 7(*c*). The second embodiment is different from the first embodiment in the structure for supporting a holder member to a frame member. Therefore, like or the same reference numerals are given to those components that are like or the same as the corresponding components of the first embodiment.

Figure 7A:
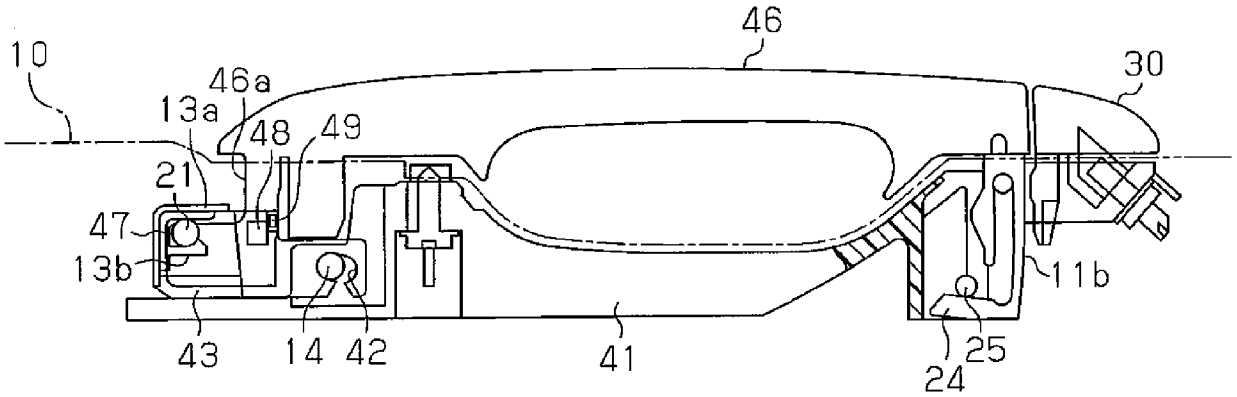
FIG. 7(*a*) is a schematic plan view illustrating a vehicle door handle device according to a second embodiment of the present invention.
Figure 7C:
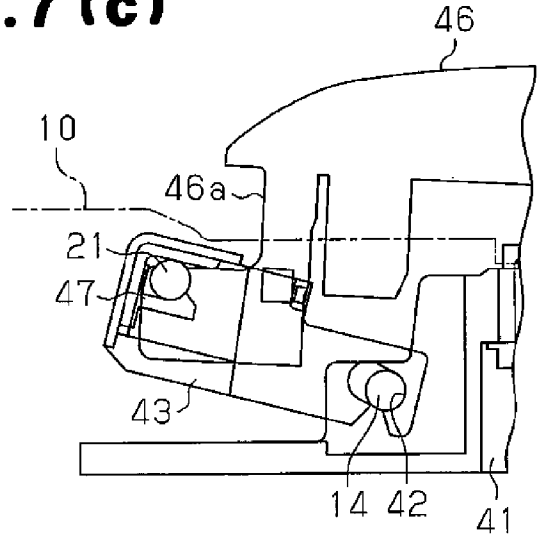
Figure 7B:
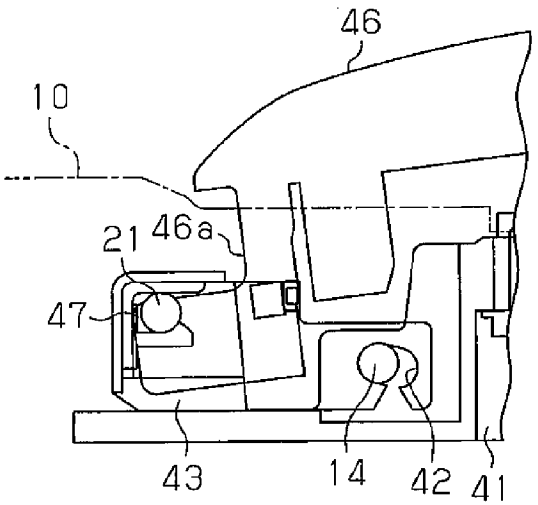

As shown in FIG. 7(*a*), an elongated hole 42 is formed in the rear end of frame member 41. The elongated hole 42 extends in the up-down direction and has a pair of open ends. The cross-sectional shape of the elongated hole 42 extends in the front-rear direction. A holder member 43 is attached to the frame member 41. The holder member 43 is made of resin and formed into a substantially rectangular box. A pin 14 is loosely fitted in the elongated hole 42. The holder member 43 is coupled to the frame member 41 to be pivotable about the pin 14. The holder member 43 is coupled to the frame member 41 to be movable within the range in which the pin 14 can be moved in the elongated hole 42. As in the first embodiment, the coil spring 15 (refer to FIG. 1) urges the frame member 41 and the holder member 43 so as to retain the frame member 41 and the holder member 43 at initial relative positions thereof. At the initial positions, the bottom walls of the frame member 41 and the holder member 43 overlap each other.

A hand grip 46 has an arm 46*a* serving as a first coupling portion. The arm 46*a* extends inward from a rear end of the hand grip 46 that faces the holder member 43. A contact portion 47 is formed at the rear end of the arm 46*a*. The contact portion 47 contacts the holder member 43 at a position in the vicinity of the pivot coupling portion 21.

Operation of the vehicle door handle device will now be described with reference to FIGS. 7(*a*) to 7(*c*).

Suppose that the sliding door 1 is fully closed, and the hand grip 46 is in the non-operational state. A user, who stands next to the sliding door 1, first grips the hand grip 46 and operates the hand grip 46 rearwardly, which is the same direction along which the sliding door 1 is opened. Then, as shown in FIG. 7(*b*), the arm 46*a* of the hand grip 46 pivots about the pivot coupling portion 21 relative to the holder member 43, which is held at the initial position by the coil spring 15, while keeping the contact portion 47 in contact with the holder member 43. When the logic of the opening operation switch 31 and the closing operation switch 32 (see FIG. 1) is detected by the control circuit 36, the actuator 6 is activated so that the sliding door 1 is released from the fully closed state.

Suppose now that the sliding door 1 is fully open, and the hand grip 46 is in the non-operational state. A user, who stands next to the hand grip 46, first grips the hand grip 46 and operates the hand grip 46 forward, which is the same direction along which the sliding door 1 is closed. As shown in FIG. 7(*c*), the leg 11*b* of the hand grip 46 pivots about the pin 23 relative to the frame member 41 as shown in FIG. 5, while pivoting the holder member 43 about the pin 14 relative to the frame member 41 against the urging force of the coil spring 15. At this time, the holder member 43 is pressed against the contact portion 47 as the arm 46*a* is moved rearward. This moves the holder member 43 along the longitudinal direction of the elongated hole 42 relative to the frame member 41. When the logic of the opening operation switch 31 and the closing operation switch 32 is detected by the control circuit 36, the actuator 6 is activated so that the sliding door 1 is released from the fully open state.

The second embodiment achieves the same advantages as the advantages (1), (2), and (4) to (8) of the first embodiment.

The above embodiments may be modified as follows.

In each embodiment, the closing operation switch 32 may be arranged above or below the opening operation switch 31. This configuration increases the amount of displacement of the arm 11*a*, 46*a* when the hand grip 11, 46 is operated toward opening side and the closing side. Therefore, by adjusting the detection sensitivity of het opening operation switch 31 and the closing operation switch 32, the opening operation and the closing operation of the hand grip 11, 46 can be detected. Further, an opening operation switch 31 and a closing operation switch 32 having different detection sensitivities may be arranged above or below the leg 11*b*.

In each embodiment, the conduction, the non-conduction, and the logic of the opening operation switch 31 and the closing operation switch 32 are merely examples, and are not limited to these.

In each embodiment, the holder member 13 may be arranged either the front end or the rear end of the door handle device.

In each embodiment, the mechanical coupling structure between the hand grip 11 and the full open lock 4 may be omitted. In this case, the full open lock 4 is unlocked solely by operation of the actuator 6.

In each embodiment, if a device for electrically opening and closing the sliding door 1 is provided, the opening or closing operation of the sliding door 1 may be started in conjunction with unlocking of the rear lock 2 caused by opening or closing operation of the hand grip 11, 46. Alternatively, during the opening or closing operation of the sliding door 1, the sliding door 1 may be stopped or reversed by operating the hand grip 11, 46 in a direction opposite to the direction in which the sliding door 1 is moving.

The invention claimed is:

1. A vehicle door handle device comprising:

a frame member adapted for being fixed to an inner surface of a panel member of a vehicle door, the vehicle door being movable forward or rearward of the vehicle, the vehicle door being held at a fully closed state by a full close latch mechanism and being held at a fully open state by a full open latch mechanism;

a holder member pivotably coupled to a front end or a rear end of the frame member;

an urging member for urging the holder member so as to retain the relative position of the holder member with respect to the frame member at an initial position;

a hand grip adapted for being arranged outside of the panel member;

a pair of first and second coupling portions that are provided at a front end and a rear end of the hand grip, the coupling portions being pivotably supported by the holder member and the frame member while extending through the panel member;

wherein by operating the hand grip in either one of a first direction in which the vehicle door in the fully closed state is opened and a second direction in which the vehicle door in the fully open state is closed, the second coupling portion of the hand grip is pivoted about the first coupling portion relative to the holder member, the holder member being retained at the initial position by the urging member, so that the vehicle door is released either from the fully closed state or the fully open state;

by operating the hand grip in the other one of the first direction in which the vehicle door in the fully closed state is opened and the second direction in which the vehicle door in the fully open state is closed, the first coupling portion of the hand grip is pivoted about the second coupling portion relative to the frame member while the holder member is pivoted relative to the frame member against urging force of the urging member, so that the vehicle door is released from the other one of the fully closed state and the fully open state; and wherein the holder member and the hand grip are separate components.

2. The vehicle door handle device according to claim 1, wherein the second coupling portion is adapted to extend through a through hole of the panel member and a cap member adapted for closing a gap extending forward from the through hole;

a set of a recess and projection is provided between the hand grip and the cap member; and when the hand grip is operated in the second direction as when the vehicle door is closed so as to pivot the holder member relative to the frame member, the set of a recess and projection inhibits the second coupling portion from pivoting relative to the holder member.

3. The vehicle door handle device according to claim 1, wherein the holder member is secured to the frame member to be freely pivotable; and when the hand grip is operated in the second direction as when the vehicle door is closed so as to pivot the holder member relative to the frame member, the first coupling portion slides on the holder member.

4. The vehicle door handle device according to claim 1, further comprising a guide projection provided in the frame member, the guide projection guiding pivoting of the second coupling portion relative to the holder member, wherein a guide groove for receiving the guide projection is formed in the second coupling portion, and the first coupling portion pivots about the guide projection and relative to the frame member.

5. The vehicle door handle device according to claim 1, wherein the second coupling portion has an operational portion, when the hand grip is operated in the first direction as when the vehicle door is opened so as to pivot the second coupling member relative to the holder member, the operational portion adapted to transmit releasing operational force to a transmitting member that is mechanically coupled to the fully close latch mechanism, the operational portion has an arcuate surface the center of curvature of which coincides with the pivot center of the first coupling portion, and when the hand grip is operated in the second direction as when the vehicle door is closed so as to pivot the first coupling portion relative to the frame member, the arcuate surface slides on the transmitting member.

6. The vehicle door handle device according to claim 1, wherein the amount of operation of the hand grip when it is operated to open the vehicle door in the fully closed state is set to be greater than the amount of operation of the hand grip when it is operated to close the vehicle door in the fully open state.

7. The vehicle door handle device according to claim 1, further comprising:

a closing operation switch that is switched to a conductive state or a non-conductive state by operating the hand grip in the second direction in which the vehicle door in the fully open state is closed; and a control circuit that detects that the closing operation switch has been switched to the conductive state or the non-conductive state, and drives an actuator to unlock the full open latch mechanism.

* * * * *